United States Patent [19]

Clifford et al.

[11] 4,402,200

[45] Sep. 6, 1983

[54] MEANS FOR APPLYING FOAMED TREATING LIQUOR

[75] Inventors: Graham F. Clifford; James K. Turner, both of Stanley, N.C.

[73] Assignee: Gaston County Dyeing Machine Company, Stanley, N.C.

[21] Appl. No.: 299,533

[22] Filed: Sep. 4, 1981

[51] Int. Cl.[3] ..... D06B 1/08

[52] U.S. Cl. ..... 68/200; 239/590; 239/597

[58] Field of Search ..... 68/200, 205 R; 239/521, 239/523, 590, 597

[56] References Cited

U.S. PATENT DOCUMENTS

| | | | |
|---|---|---|---|
| 2,940,418 | 6/1960 | Penrod et al. | 239/597 |
| 3,022,016 | 2/1962 | Shrewsbury | 239/597 |
| 3,083,685 | 4/1963 | Colgan | 118/410 |
| 3,263,933 | 8/1966 | Porwancher et al. | 239/590 |
| 3,750,955 | 8/1973 | Nakai et al. | 239/597 |

*Primary Examiner*—Philip R. Coe
*Assistant Examiner*—Thomas W. Epting
*Attorney, Agent, or Firm*—Richards, Shefte & Pinckney

[57] ABSTRACT

Means for applying foamed treating liquor to a flat width traveling textile substrate using a cylindrical supporting member extending axially transversely across the width of the substrate and supporting a projecting applicator nozzle. A circumferentially extending distribution chamber is formed on the cylindrical supporting member by a cover plate mounted in spaced relation on the cylindrical supporting member by resilient side strips to which the cover plate is tightened circumferentially in sealing disposition. The distribution chamber diverges from an inlet port adjacent the nozzle circumferentially around a major extent of the cylindrical supporting member to the full width of the nozzle. End closures are slidably manipulated in the ends of the nozzle to limit the transverse extent of the nozzle opening in following relation to variations in the transverse positions of the edges of the traveling substrate in response to a sensing device. A plate-like projection may be provided across the distribution chamber adjacent the nozzle to restrict flow of the foamed treating liquor and thereby assure proper uniform distribution of the liquor across the distribution chamber to the nozzle. The projection preferably tapers from a maximum circumferential extent at the center to minimum extents at the outer ends for further assurance of proper transverse distribution of the foamed treating liquor across the distribution chamber to the nozzle.

17 Claims, 15 Drawing Figures

MEANS FOR APPLYING FOAMED TREATING LIQUOR

BACKGROUND OF THE INVENTION

The present invention relates to means for applying foamed treating liquor and more particularly to means for applying foamed treating liquor through a distribution chamber to a flat width of traveling substrate.

Applying foamed treating liquor to traveling textile substrates is practiced to advantage in the prior art by distributing the foamed liquor from an input conduit through a distribution chamber that distributes the foamed liquor transversely and delivers it to a nozzle extending transversely across a flat width traveling textile substrate to which the nozzle dispenses the foamed treating liquor. An effective prior art means of this type is disclosed in Clifford and Zeiffer U.S. Pat. No. 4,237,818, issued Dec. 9, 1980, entitled Means For Applying Treating Liquor To Textile Substrate, which discloses an upstanding distribution chamber that flares from a central collection section transversely as it extends vertically to the traveling substrate at which the distribution chamber is generally the same width as the applicator nozzle that applies foamed liquor across the width of the substrate. A cylindrical throttling member is adjustably positioned in the nozzle to provide and adjustable restriction for facilitating uniform distribution of the foamed treating liquor along the nozzle. Excellent results have been obtained in applying foamed treating liquor from below a traveling textile substrate with the means of this prior patent, but it is not readily adaptable to application from above a traveling substrate because of the tendency of the liquor to flow straight downwardly rather than transversely in a vertically extending distribution chamber and because a considerable height is required to accommodate the distribution chamber. Also, as it has relatively wide flat surfaces it is not inherently rigid, and, furthermore, the use of a cylindrical throttling member can cause an abrupt change in the flow that may make it difficult to control the quality and uniform distribution of the foamed treating liquor across the width of the traveling substrate.

The present invention provides an improvement over the means of the above-described prior art as it utilizes a cylindrically extending distribution chamber through which the foamed treating liquor flows generally circumferentially rather than vertically straight, the cylindrical shape reduces substantially the height required for a given flow length as compared with a vertical distribution chamber and the cylindrical construction is inherently more rigid than a flat construction. Furthermore, the present invention provides a plate-like flow restricting means of appreciable circumferential extent for smooth easily controlled action to facilitate uniform transverse distribution of the foamed treating liquor flowing therepast.

SUMMARY OF THE INVENTION

Briefly described, the means for applying foamed treating liquor to a flat width of traveling substrate of the present invention includes a cylindrical supporting member that is mounted to extend transversely across the width of the traveling substrate adjacent a surface of the substrate. An applicator nozzle is mounted on the supporting member and projects therefrom into foam applying disposition across the width of the substrate. A cover plate is mounted on the cylindrical supporting member in spaced relation to the surface thereof to form a foam distribution chamber therebetween and communicating with the nozzle for distributing foamed treating liquor thereto. The transverse extent of the distribution chamber is defined by side walls mounted on the surface of the supporting member and supporting the cover plate. An inlet port communicates with the distribution chamber at a circumferential spacing from the nozzle and intermediate the transverse extent of the cylindrical supporting member. The side walls diverge from a relatively close spacing at the inlet port to approximately the full width of the nozzle at the nozzle. Thus, foamed treating liquor introduced into the distribution chamber through the inlet port will be distributed transversely through the width of the chamber as it flows circumferentially to the nozzle for application from the nozzle across the width of the substrate.

Preferably, the cover plate and distribution chamber formed thereby extend circumferentially over a major circumferential extent of the surface of the cylindrical supporting member, and in the preferred embodiment the nozzle projects in the vertical plane of the axis of the cylindrical supporting member and the input port is adjacent the nozzle with the cover plate and defined distribution chamber extending from the input port around through the vertical plane and around to the nozzle.

In the preferred embodiment the side walls are in the form of resilient sealing strips and the cover plate is tightened circumferentially against the sealing strips by having one end secured to the nozzle and the other end engaged by tightening means that bias the cover plate circumferentially. Conveniently, the cover plate can be easily removed for ready access to the interior of the distribution chamber by releasing the tightening means. The cylindrical supporting member is hollow and has conveniently mounted in each end thereof operating means in the form of a piston cylinder mechanism for manipulating end closures that are slidable in the ends of the applicator nozzle to limit the transverse foam applying extent of the nozzle.

Preferably restricting means projects from the surface of the cylindrical supporting member transversely across the distribution chamber adjacent the applicator nozzle and is of a projecting extent less than the depth of the chamber for restricting flow of the foamed treatment liquor therepast to thereby facilitate transverse distribution of the liquor in the distribution chamber. In the preferred embodiment the restricting means is in the form of a plate-like projection of appreciable circumferential extent that varies from a maximum extent at substantially the transverse center of to minimum extents at the transverse sides of the distribution chamber.

DETAILED DESCRIPTION OF THE PREFERRED EMBODIMENTS

Figure 1:
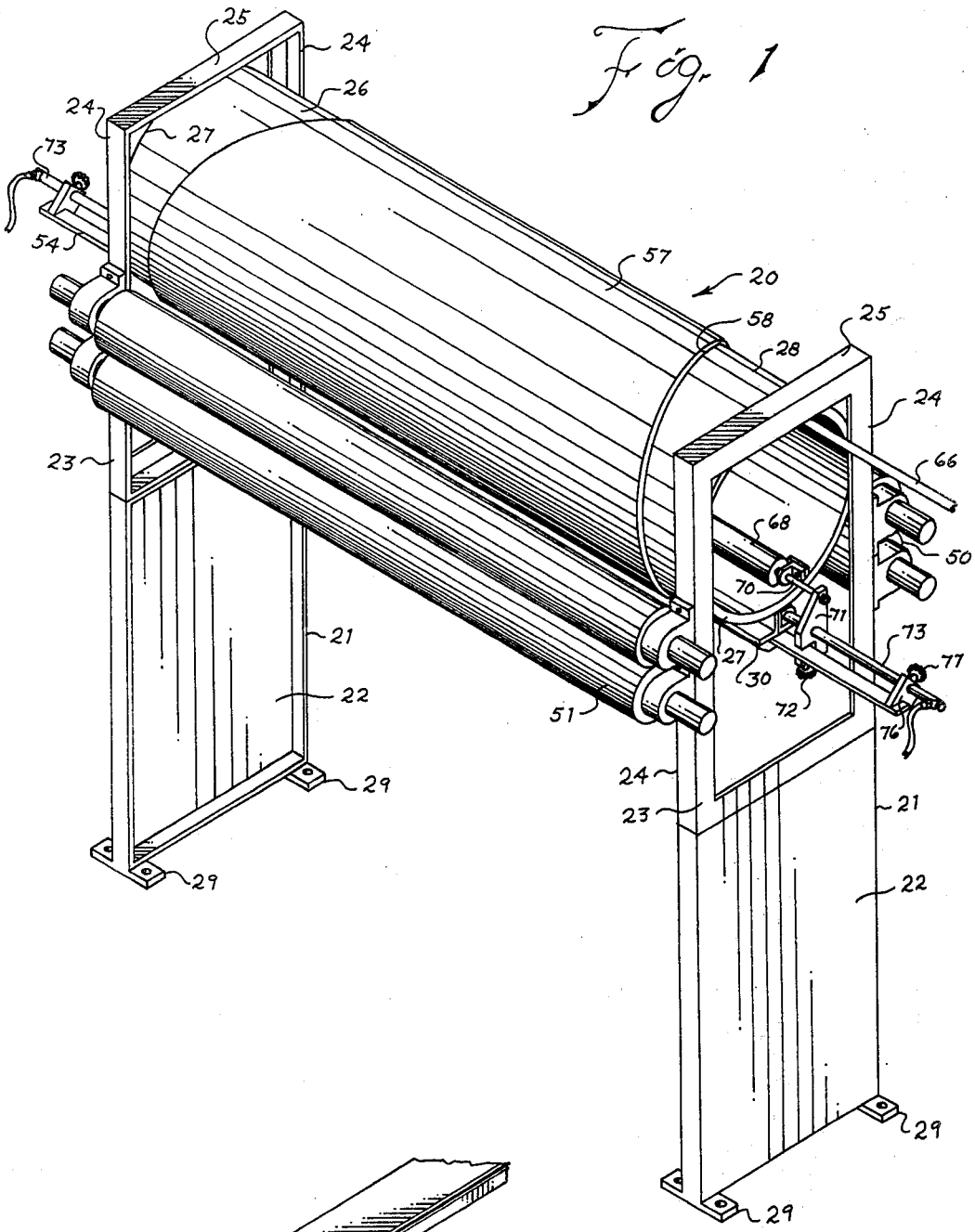
FIG. 1 is a perspective view of a first preferred embodiment of the means for applying foamed treating liquor according to the present invention as viewed from one side of the device.
Figure 5:
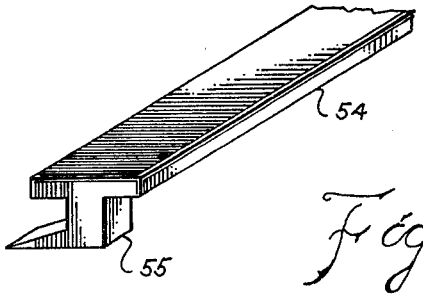
FIG. 5 is an enlarged perspective view of the end closure slide in the nozzle of the device of FIG. 1.
Figure 2:
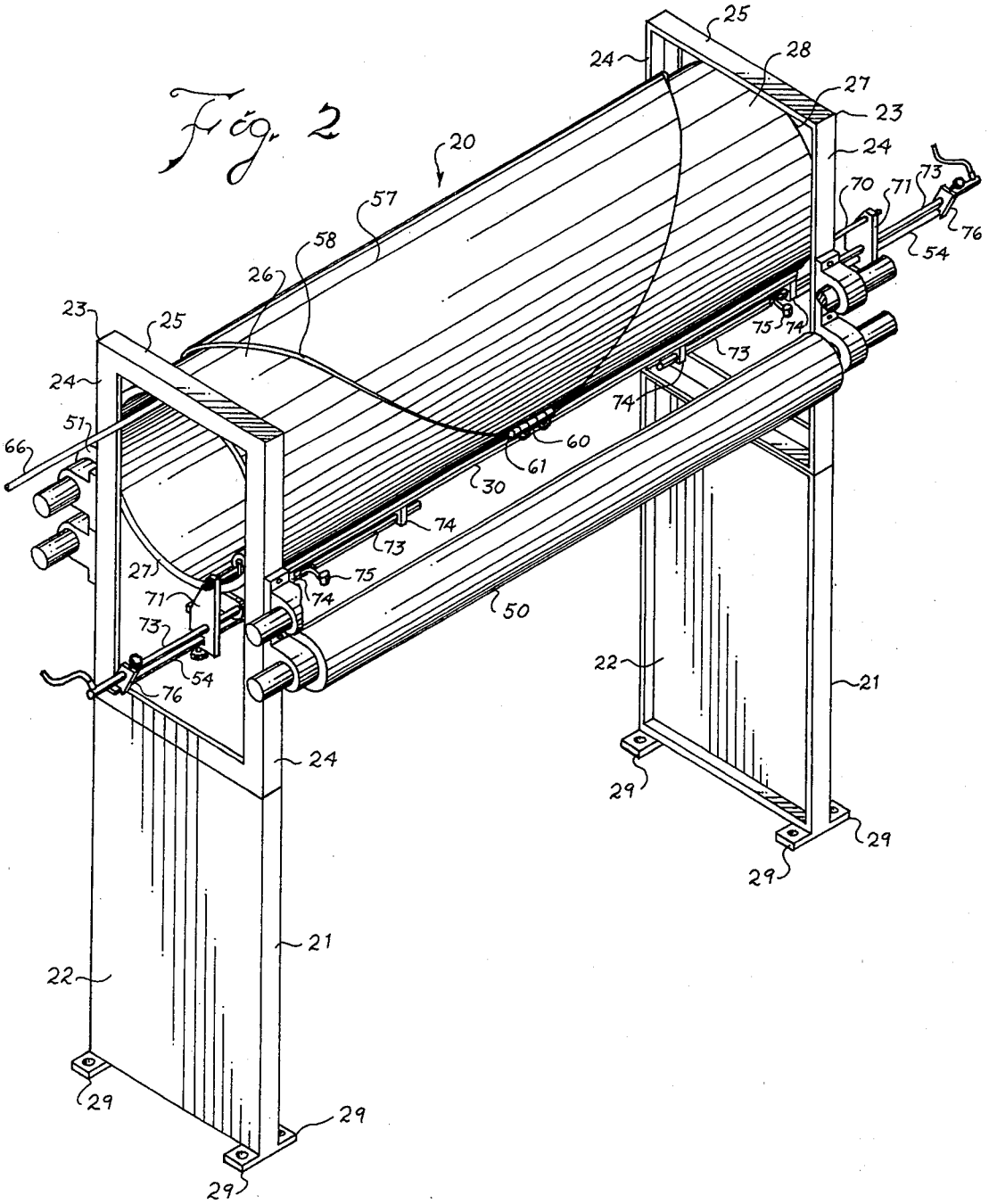
FIG. 2 is a view similar to FIG. 1 as viewed from the other side of the device.

In the first of the preferred embodiments of the present invention as seen in FIGS. 1–9, the means for applying foamed treating liquor is incorporated in a free standing device 20 for arrangement in a textile fabric treating range through which the textile fabric passes as a flat width of traveling substrate S.

The device 20 has a pair of opposed end frames 21 spaced sufficiently to permit the substrate S to pass therebetween. Each of the end frames includes a base portion 22 and an open top portion 23 formed with spaced vertically extending sides 24 and a crosspiece 25 connecting the tops of the sides 24. The sides 24 and crosspiece 25 are L-shaped to provide a recess for mounting, as by welding, a cylindrical supporting member 26 that extends transversely across the substrate S and has its outer ends 27 seated in the open top portion 23 of the end frames 21 with the outer surface 28 of the cylindrical supporting member 26 in tengential contact with the L-shaped sides 24 and crosspiece 25 of the end frames 21. This arrangement is fixed in place by anchoring of feet 29 of the end frames 21 in the floor in any suitable manner.

Figure 3:
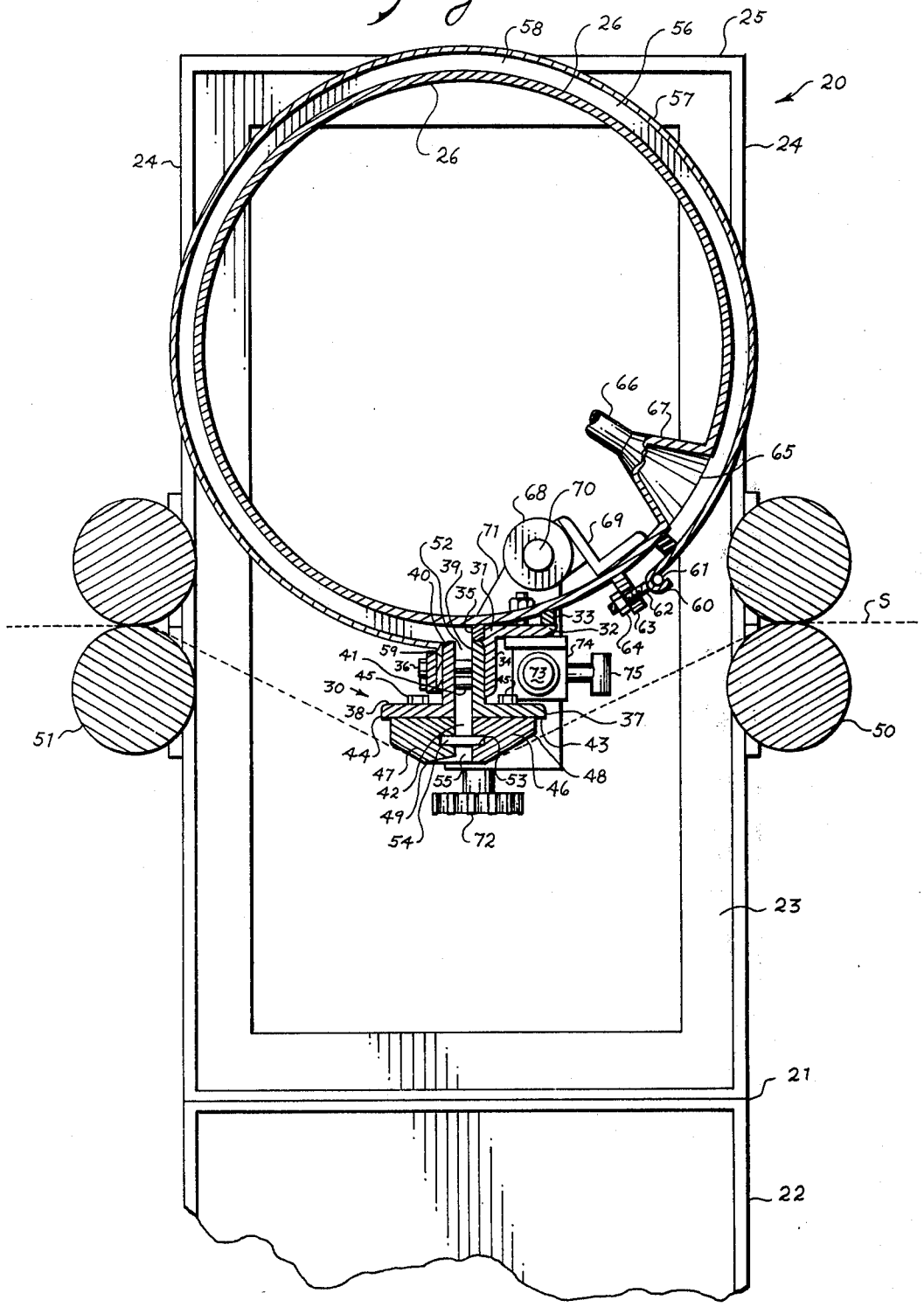
FIG. 3 is a vertical section of the device of FIG. 1 taken in a plane perpendicular to the axis.
Figure 4:
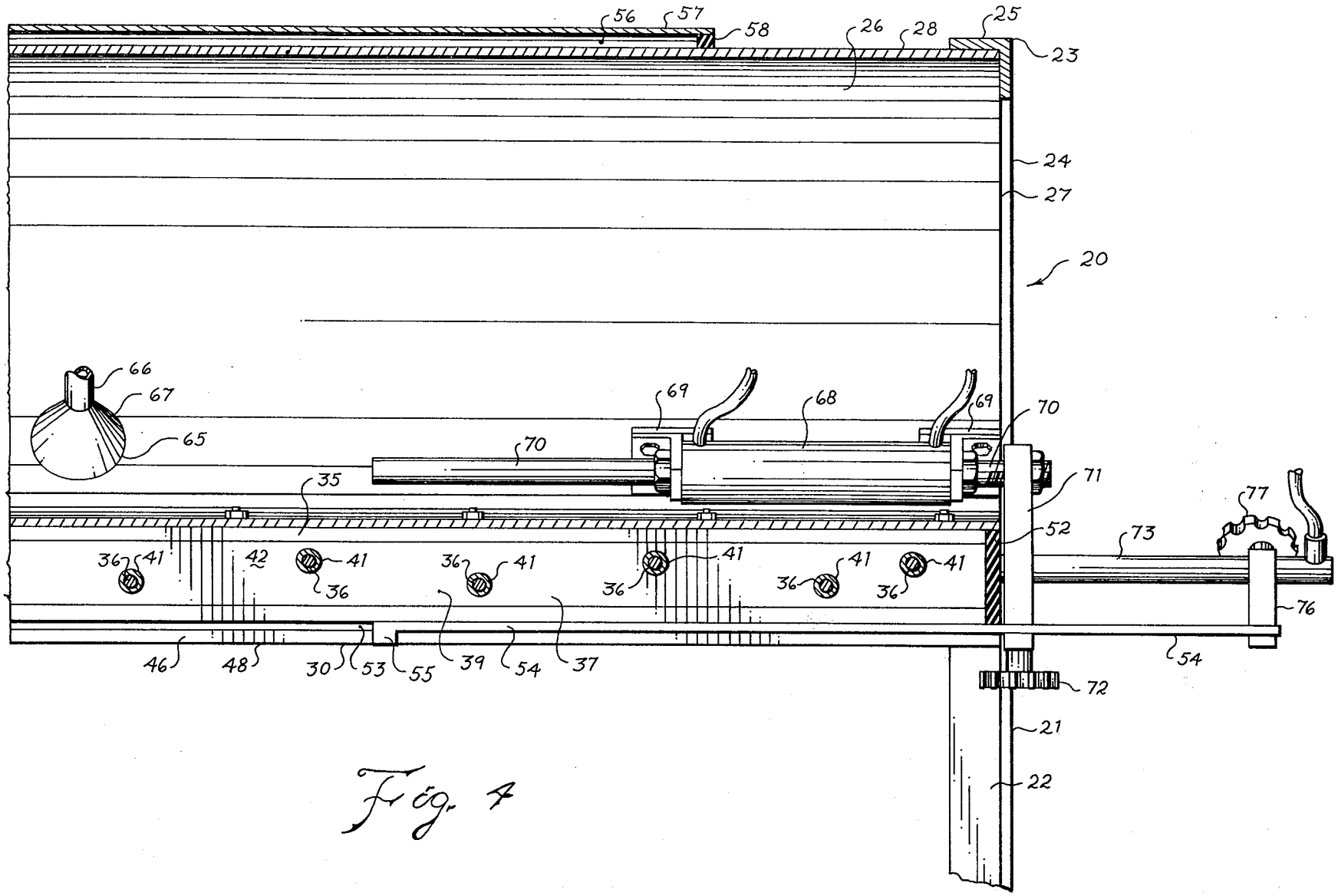
FIG. 4 is a vertical section of the device of FIG. 1 taken along the axis.
Figure 6:
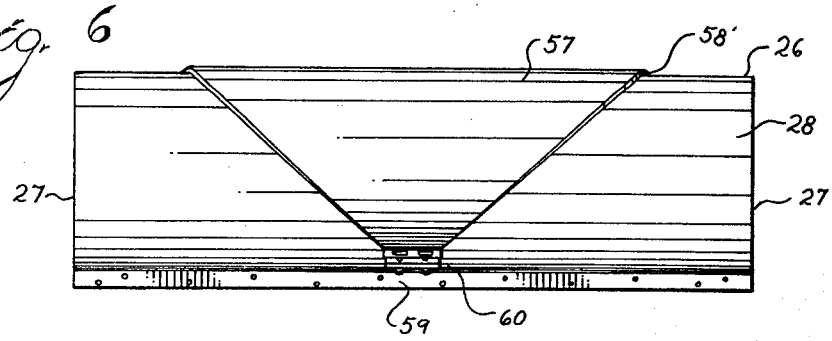
FIG. 6 is a side elevation of the cylindrical supporting member and cover plate components of the device of FIG. 1.
Figure 7:
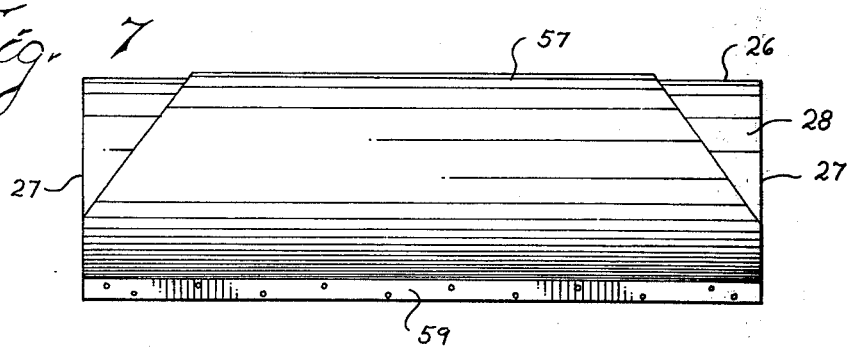
FIG. 7 is a view similar to FIG. 6 as viewed from the opposite side.

The cylindrical supporting member 26 is mounted for disposition above the path of the traveling substrate S and has secured thereto an applicator nozzle 30 that projects vertically downward thereform in the same vertical plane as the axis of the cylindrical supporting member 26. This applicator nozzle 30 is secured to the outer surface 28 of the cylindrical supporting member 26 by an angle bracket 31 that has a horizontal portion 32 secured, as by welding, to the cylindrical supporting member outer surface 28 and to an offset spacer element 33 that is mounted between the outer edge of the horizontal portion 32 of the angle bracket 31 and to the cylindrical supporting member 26. The angle bracket 31 has a vertical portion 34 secured to the cylindrical supporting member outer surface 28. Attached to the vertical portion 34 of the angle 31 by bolts 36 are a pair of spaced angle members 37 and 38. One of these angle members 37 has a vertical portion 39 abutting the vertical portion 34 of the angle bracket 31 and the other angle member 38 has a vertical portion 40 spaced from the vertical portion 39 of the angle member 37 by spacers 41 mounted on the bolts 36 intermediate the vertical portions 39 and 40 such that the space between the vertical portions 39 and 40 provides a vertical passageway 42 through the applicator nozzle 30. A filler rib 35 is disposed to fill the space above the angle member 37. Mounted to horizontal portions 43 and 44 by bolts 45 are a pair of nozzle blocks 46 and 47 having the same spacing as the angle members 37 and 38 to provide a continuation of the vertical passageway 42. These nozzle blocks 46 and 47 are horizontally adjustable to vary the spacing as desired. Each of the nozzle blocks 46 and 47 have outer surfaces 46 and 47 across which the textile substrate S travels. The outer surface 48 of the nozzle block 46 on the right as viewed in FIG. 3 is flat adjacent the opening of the passageway 42 and tapers upwardly away therefrom for effecting a seal of the applicator passageway as the textile substrate S passes over the junction of the flat and the tapered surfaces. The substrate S passes downwardly from an infeed guide roll 50 from a level above the level of the bottom of the nozzle blocks 46 and 47. The outer surface 49 of the nozzle block 47 tapers inwardly toward the opening of the passageway 42 to extend that opening to the left in a wedge shape that facilitates application of the foamed treating liquor onto and into the traveling substrate S as it moves across the opening of the passageway 42. The outer surface 49 of the nozzle block 47 tapers away from the passageway in the same manner and for the same purpose as the outer surface 48 of the nozzle block 46, following which the textile substrate S travels to an outfeed guide roll 51. In the accompanying drawings there are pairs of infeed and outfeed rolls illustrated, which can be used, but for simplicity and to avoid contact with the surface to which the foamed treating liquor is applied, it is preferred that only the bottom ones of the pairs of rolls be used, with the upper rolls being omitted completely.

The ends of the applicator nozzle 30 are closed to prevent foamed treating liquid from escaping other than through the bottom opening of the passageway 42 by end seals 52 disposed between the ends of the angle members 37 and 38 and extending downwardly to the level of transverse grooves formed in the spacer blocks 46 and 47 and opening into the passageway 42. These grooves 53 are aligned and form a slideway for a slidable bar mounted in each end of the applicator nozzle 30. On the inner ends of the slidable bars 54 are end closures in the form of plugs having the same shape as the passageway openings formed by the nozzle blocks 46 and 47 (see FIGS. 3 and 5). With this arrangement the end closure plugs 55 and slidable bars 54 are slidable transversely in the ends of the applicator nozzle 30 to limit the transverse foam applying extent of the opening of the passageway 42.

Foamed treating liquor is fed to the applicator nozzle 30 across the transverse extent thereof for feeding onto the flat width of the traveling textile substrate S from the nozzle passageway 42 by a distribution chamber 56 uniquely formed on the surface of the cylindrical supporting member 26. This distribution chamber 56 utilizes the outer surface 28 of the cylindrical supporting member 26 as its inner surface and its outer surface is formed by a cover plate 57 mounted on the cylindrical supporting member 26 in spaced relation to the outer surface thereof to define the distribution chamber 56 therebetween. The cover plate is mounted in this spaced relation on side walls 58 in the form of resilient strips of rubber or similar material having a square cross section. The cover plate is secured in position in sealing disposition with the application nozzle 30 by an end flange 59 (see FIGS. 3 and 6–9) projecting from the cover plate 57 and forming an end thereof that is secured to the left hand angle member 38 of the nozzle applicator 30 by the aforementioned bolts 36 that hold the angle members 37 and 38 in spaced relation. This end flange 59 extends across the full width of the applicator nozzle 30. The other end 60 of the cover plate 57 is relatively narrow and is curved to form a hook-like shape to receive the cross bars 61 of bolts 62 that extend through the cover plate end 60 and through an attaching plate 63 secured to and projecting radially from the outer surface 28 of the cylindrical supporting member 26 at a slight circumferential spacing from the end 60 of the cover plate 57. Thus, upon tightening of the nuts 64 on the bolts 62 the cover plate 57 is tightened circumferentially against the resilient side wall strips 58 to form a sealed connection between the cover plate 57, the side wall strips 58 and the outer surface 28 of the cylindrical supporting member 26, thereby providing a foam distribution chamber that communicates with the applicator nozzle 30 and extends circumferentially around the surface of the cylindrical supporting member 26.

Foamed treating liquor is introduced into the distribution chamber 56 through an inlet port 65 opening through the cylindrical supporting member 26 at the end 60 of the cover plate 57 that is spaced from the applicator nozzle 30. An infeed conduit 66 extends from a source of supply of foamed treating liquor remote from the cylindrical supporting member 26 into the hollow interior thereof and has a connecting portion 67 of conical configuration that enlarges the conduit to the size of the inlet port 65.

Figure 9:
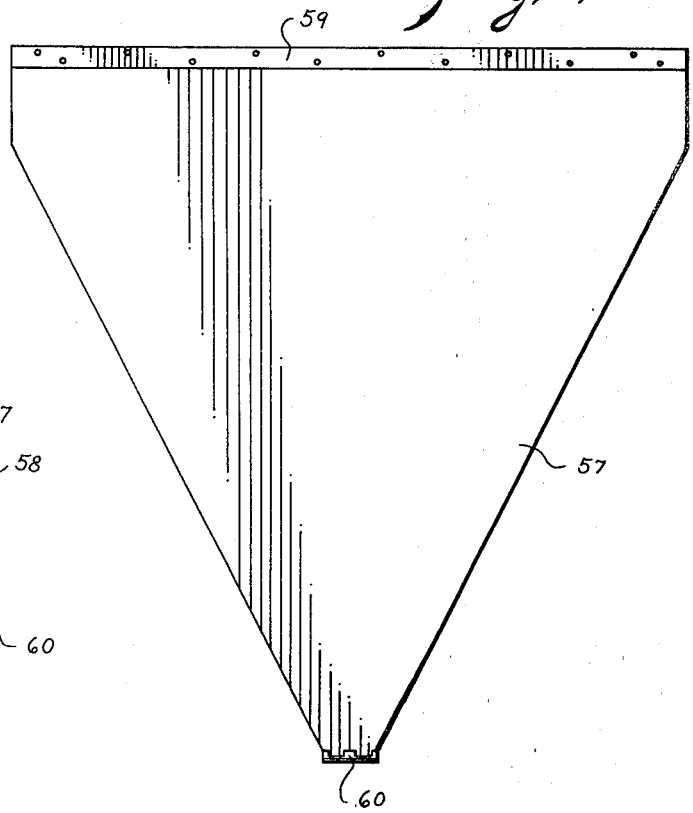
FIG. 9 is a plan view of the cover plate component of the device of FIG. 1 shown in flat condition before forming cylindrically to mount on the cylindrical supporting member.
Figure 8:
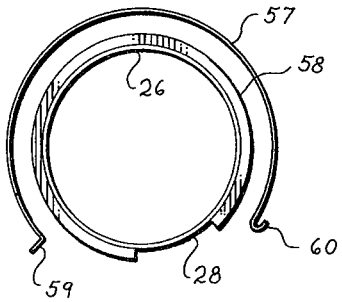
FIG. 8 is an end elevation of the cylindrical supporting member and cover plate component of the device of FIG. 1 showing the cover plate opened during removal from the cylindrical supporting member.
Figure 10:
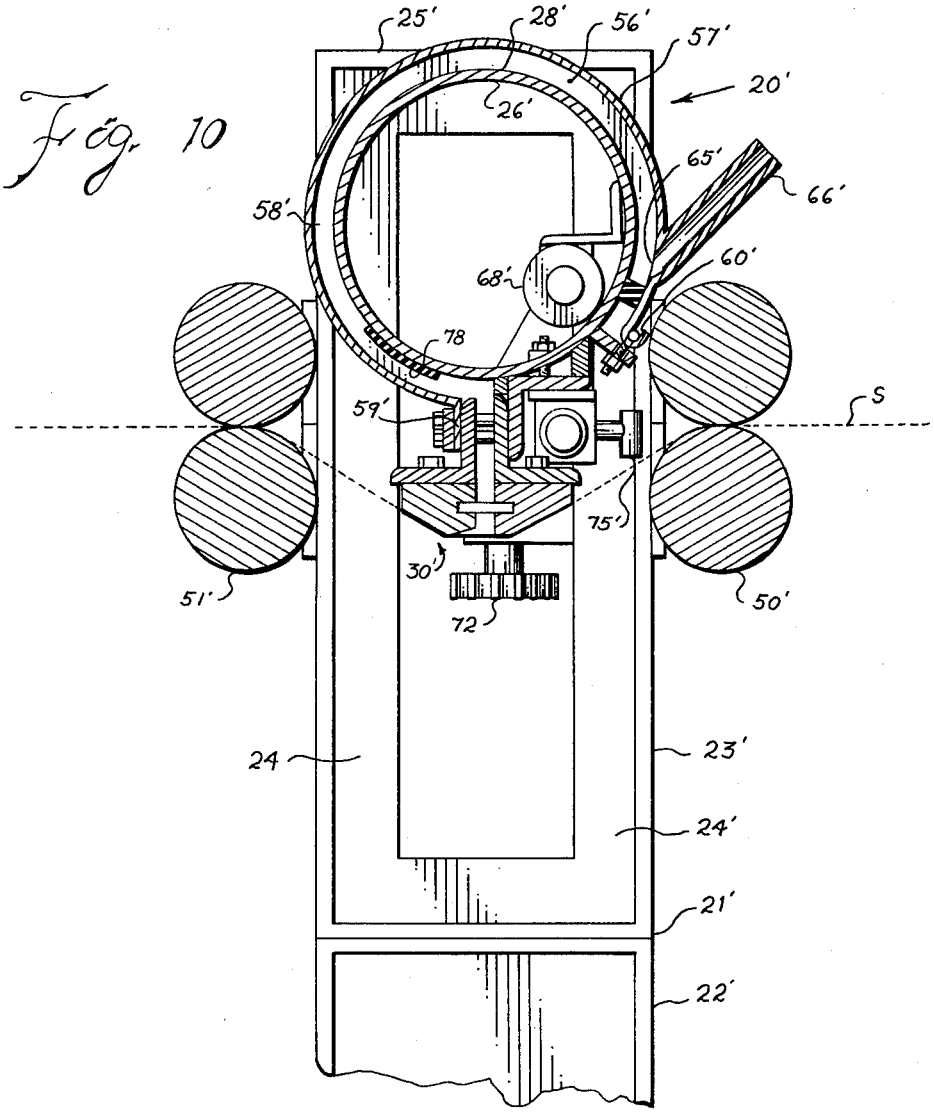
FIG. 10 is a vertical section of a second preferred embodiment of the means for applying foamed treating liquor according to the present invention taken along a plane perpendicular to the axis of the device.

To preserve the foamed texture of the treating liquor and to obtain uniform distribution of the treating liquor across the transverse extent of the vertical passageway 42 of the applicator nozzle 30 for satisfactory uniform distribution of the foamed treating liquor onto the textile substrate S it is important that the transverse lengthening of the extent of the distribution chamber from the relatively narrow inlet port 65 to the long passageway 42 be smooth and of substantial circumferential extent. For this purpose, the edges of the cover plate and the side strips 58 diverge from the inlet port 65 to the full extent of the applicator nozzle 30 over an extended circumferential extent of the cylindrical supporting member 26. In FIG. 3, it is seen that the inlet port 65 is located adjacent the applicator nozzle 30, being spaced only about 60° therefrom, and as a result the cover plate 57 and defined distribution chamber 56 extends circumferentially over a major circumferential extent of the surface 28 of the cylindrical supporting member 26. In this arrangement the inlet port 65 is disposed on one side of the vertical plane of the axis of the cylindrical supporting member 26 and applicator nozzle 30 and the cover plate 57 and distribution chamber 56 extends circumferentially upwardly, around the cylindrical supporting member 26 through this vertical plane and around to the applicator nozzle 30. As a result of the circumferential extent of the distribution chamber 56, the foamed treating liquor will spread transversely uniformly as it flows first upwardly around the cylindrical supporting member 26 and then downwardly to the applicator nozzle 30 at which it approaches in a substantially less than vertical path. To assure proper uniform transverse distribution of the foamed treating liquor by the time it reaches the applicator nozzle 30, the side strips 58 and the edges of the cover plate 57 diverge only moderately from the close spacing at the inlet port 65. In the embodiment illustrated in FIGS. 1–9, and as indicated in the FIG. 9 illustration of the cover plate in flat disposition before it is formed into its circumferential shape, the sides of the cover plate 57 diverge at a relatively small angle. A comparison of the illustration in FIG. 9 of the cover plate 57 in its flat condition with the circumferentially cylindrical configuration in FIGS. 6 and 7 demonstrates the considerable reduction in height of the device 20 that is necessary to accomodate a distribution chamber 56 of sufficient extent to accomplish proper uniform transverse distribution of the foamed treating liquor from an inlet port to a transversely extending nozzle. This FIG. 9 also illustrates the general size of the cover plate 57, which would be relatively flexible and unstable in flat condition when a relatively thin metal, which would require structural rigidifying for use in making a distribution chamber, whereas in the present invention the cover plate 57 is wrapped around the cylindrical supporting member 26 to take a circumferentially cylindrical shape itself, which is a physical shape of significantly more rigidity than a flat sheet. In addition, the use of a thin sheet, while sufficient to provide adequate rigidity for sealing to form the distribution chamber 56, is sufficiently flexible when not secured in plate to allow the ends 59 and 60 to be spread apart sufficiently to permit easy removal of the cover plate 57 from the cylindrical supporting member 26 for ready access to the interior of the distribution chamber 56 for cleaning or inspection (see FIG. 8).

The cylindrical shape of the supporting member 26 is relatively inexpensive to manufacture and can be made of relatively thin material because of the rigidity of a cylindrical shape. Also, as it is hollow, it conveniently provides a space for the feed conduit 66 and connecting portion 67 for feeding of the foamed treating liquor to the inlet port 65. The interior space also is convenient for mounting piston cylinder mechanisms 68 in each end 27, which provide manipulating means for the aforementioned slidable bars 54 and plugs 55 that form the end closures for adjusting the transverse extent of the opening in the passageway 42 of the applicator nozzle 30. For this purpose, the piston cylinder mechanisms 68 are each mounted on an angle bracket 69 projecting inwardly from the interior surface of the cylindrical supporting member 26 for extension parallel to the axis of the cylindrical supporting member 26. Piston rods 70 of the piston cylinder mechanisms 68 project outwardly from the ends 27 of the cylindrical supporting member 26 for attachment to vertically extending connecting plates that extend downwardly for adjustable attachment to the aforementioned slide bars 54, which fit in slots in the connecting plates 71 and are releasably secured therein by tightening knobs 72. The connecting plates 71 also provide slidable support for sensor supporting rods 73 that extend along the side of the applicator nozzle 30 in bearing blocks 74 mounted on the aforementioned horizontal portion 32 of the angle bracket 31 for the applicator nozzle 30. These sensor supporting rods 73 carry electric eye sensors capable of detecting the edges of the flat width traveling substrate for responsive control of the end closure slide bars 54 and plugs 55. The electrical wiring for the electric eye sensors 75 extends through the sensor supporting rods 73 and out the outer ends thereof to electrical control circuitry of conventional design that forms no part of the present invention. The outer ends of the sensor supporting rods 73 are adjustably secured in end brackets 76 secured to and projecting from the outer ends of the slidable bars 54, with tightening knobs adjustably tightening the sensor supporting rods 73 in relation to the slidable bars 54. With this arrangement, the relationship between the electric eye sensors 75 and the end closure plugs 55 can be adjusted to a desired transverse relationship and the electric eye sensors 75 will detect a change in the transverse location of the edges of the traveling substrate S, which detection will activate a response that operates the piston cylinder mechanisms 68 to extend or retract the piston rods 70 to cause the connected electric eye sensors to follow the changes in the transverse positions of the edges of the traveling substrate S and at the same time cause transverse shifting of the slidable bars 54 and plugs 55 to vary the end closing of the passageway 42 in the applicator nozzle 30 to maintain a proper transverse application of foamed treating liquor to the traveling substrate S.

The second of the preferred embodiments of the present invention which is illustrated in FIGS. 10–15 is similar in construction to the embodiment of FIGS. 1–9. The same reference numerals but with a prime added, are used to designate the parts of the second embodiment corresponding to those of the first embodiment and those parts of the second embodiment that are mentioned hereinafter are identical in construction and function as the corresponding parts in the first embodiment. The purpose of the second embodiment is to further reduce the dimensions of the device while obtaining proper transverse distribution of the foamed treating liquor in the distribution chamber 56' between the inlet port 65' and the applicator nozzle 30'. As mentioned in regard to the first embodiment, the divergence of the sides of the cover plate 57 and side wall strips 58 is limited to assure proper transverse distribution of the foamed treating liquor, which requires a significant circumferential extent that determines the height of the cylindrical supporting member 26 necessary to provide this circumferential extent. To reduce this circumferential extent so that a smaller diameter cylindrical supporting member can be used would require a wider divergence than practically possible with the embodiment shown in FIGS. 1–9. However, a wide divergence of the distribution chamber is obtained in the second embodiment of FIGS. 10–14 by the use of means projecting from the surface of the cylindrical supporting member transversely across the distribution chamber adjacent the applicator nozzle. In the illustrated embodiment this restricting means is in the form of a plate-like projection 78 that can be made of plastic, metal or any suitable material capable of forming to the shape of the surface of the cylindrical supporting member. This plate-like projection 78 is secured to the outer surface 28' of the cylindrical supporting member 26' adjacent the applicator nozzle 30' and projecting into the distribution chamber 56' an extent less than the depth of the distribution chamber 56' for restricting flow of the foamed treating liquor therepast and thereby facilitate transverse distribution of the foamed treating liquor in the distribution chamber 56' before it reaches the applicator nozzle 30'. This plate-like projection has an appreciable circumferential extent within the distribution chamber 56' so that there is an extended path of resistance to flow, thereby facilitating adequate distribution of the foamed treating liquor across the distribution chamber 56' so that widely diverging side walls 58' and cover plate 57' can be utilized with a correspondingly circumferentially small cylindrical supporting member 26'. Because of the appreciable circumferential extent of the projection 78, the amount of depth restriction can be minimized in comparison with a prior art type of rod or weir restriction. Furthermore, the circumferential extent of the plate-like projection 78 may vary across the transverse extent of the distribution chamber 56' to effect uniform distribution. For example, in the embodiment illustrated the maximum circumferential extent is provided at the center and the plate-like projection 78 tapers to minimum circumferential extents at the transverse sides of the distribution chamber. In this way, the foamed treating liquor that follows a circular path of least resistance would be subjected to the greatest restriction and would tend to spread transversely. With selected adjustment of the taper it is possible to obtain a desired uniform transverse distribution. It would also be feasible to incorporate other types of depth adjustment as well as circumferential extent adjustment by other means that could be adjusted or variably selected to vary the flow areas through the distribution chamber 56'.

By the use of this plate-like projection 78' a much greater divergence can be utilized in the side edges of the cover plate 57' and a significantly smaller diameter cylindrical supporting member 26' may be used. The reduction in diameter of the cylindrical supporting member 26' can be seen by comparing FIG. 10 with FIG. 3 of the first embodiment. It should be noted that in the illustration of both embodiments the depth of the distribution chambers is exaggerated for purposes of illustration and that the depth would be the same in both embodiments. The projection of the plate-like projection 78 in the second embodiment is approximately half the depth of the distribution chamber 56', but could be of a different extent to suit particular conditions or desired results.

Because of the reduced diameter of the cylindrical supporting member 26' of the second embodiment, the inlet port 65' is located in the cover plate 57' rather than in the cylindrical supporting member 26' and the conduit 66' feeding the foamed treating liquor to the inlet port 65' is located exteriorly rather than interiorly as it is in the first embodiment. Also, to facilitate initial transverse distribution of the foamed treating liquor in the distribution chamber 56' rather than allowing the liquor to follow a circular path, the conduit 66' is connected to the cover plate 57' at an acute angle to the adjacent circumferential extent of the cover plate to cause a substantial change in direction of flow of the foamed treating liquor as it enters the distribution chamber 56'.

Another advantage of the small diameter cylindrical supporting member 26' of the second embodiment is that the entire cylindrical supporting member 26' with the angle members 37 and 38 of the applicator nozzle 30' attached can be handled in a milling machine to form the outer surfaces of the horizontal portions 43 and 44 of the angle members 37 and 38 in sufficient precision aligned for mounting of the nozzle blocks 46 and 47 thereon to assure alignment of end closure guideway grooves 53 for sliding positioning of the slide bar 54.

Figure 15:
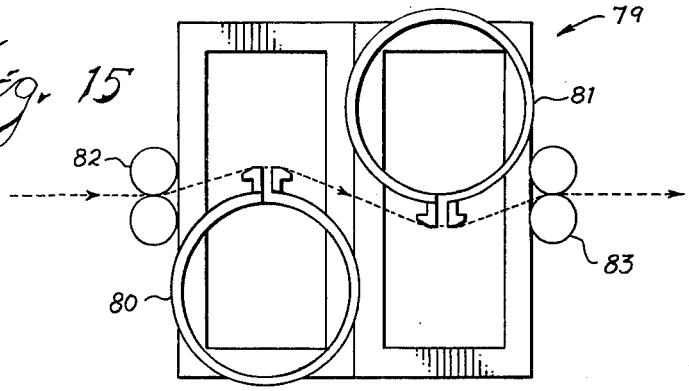
FIG. 15 is a diagrammatic end view of a combination of two of the devices of FIG. 10 arranged for application of foamed treating liquor to both sides of a traveling textile substrate.
Figure 11:
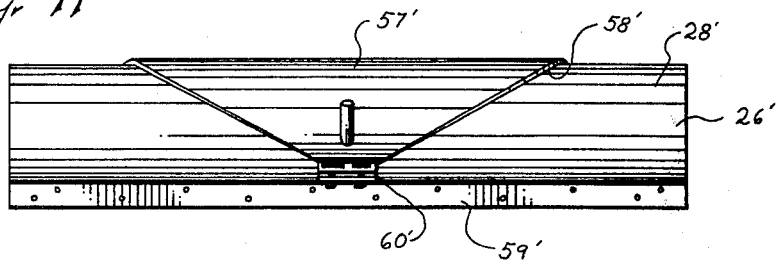
FIG. 11 is a side elevation of the cylindrical supporting member and cover plate components of the device of FIG. 10.
Figure 12:
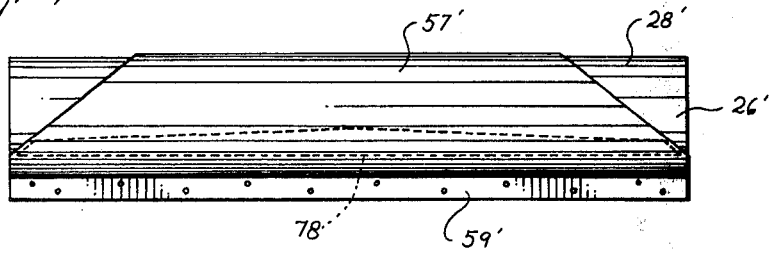
FIG. 12 is a view similar to FIG. 11 taken from the opposite side of the device.
Figure 13:
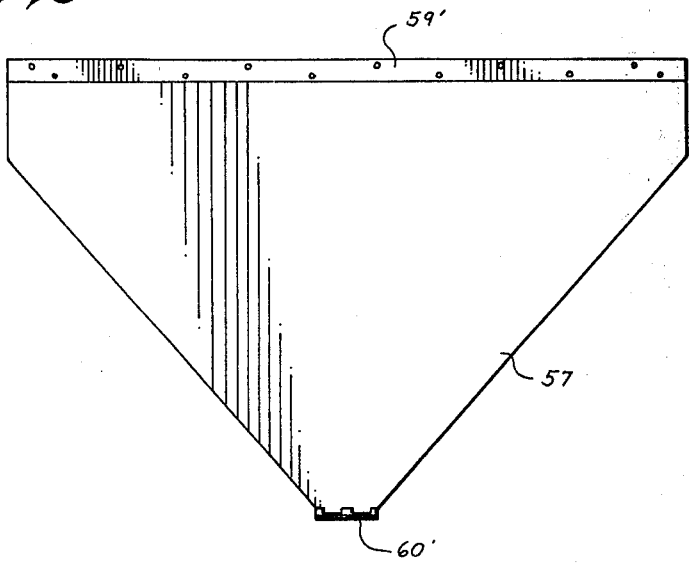
FIG. 13 is a plan view of the cover plate of the device of FIG. 10 in flat condition prior to forming into a cylindrical shape for mounting on the cylindrical supporting member.
Figure 14:
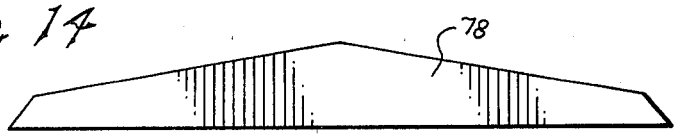
FIG. 14 is a plan view of the restriction plate used in the device of FIG. 10 to control flow of foamed treating liquor with the plate shown in flat condition prior to forming for mounting on the surface of the cylindrical supporting member.

Both of the embodiments illustrated in FIGS. 1–14 and described in detail hereinabove are arranged with the applicator nozzle 30 or 30' disposed for applying foamed treating liquor to the upper surface of a traveling textile substrate S, but it should be understood that the devices can be utilized as well to apply foamed treating liquor to the lower surface of a traveling substrate, or to either or both surfaces of a substrate traveling vertically, horizontally or in any oblique direction. In this regard, FIG. 15 is a diagrammatic illustration of an arrangement 79 of two devices 80 and 81, both of the same form as the device of FIGS. 10–14, but with the left device as viewed in FIG. 15 being inverted so that the applicator nozzle is disposed above the cylindrical supporting member to apply foamed treating liquor to the lower surface of the traveling substrate while the right device 80 is disposed as in FIGS. 10–14 to apply foamed treating liquor to the upper surface of the traveling substrate S. The two applicator nozzles of the devices 80 and 81 are overlappingly offset vertically to assure a nozzle contacting path of the traveling substrate S which is guided under a guide roll 82 at the left of the arrangement 79 and over a guide roll 83 at the right of the arrangement 79. A pair of rolls is illustrated at each side of the arrangement 79, but only the upper left roll 82 and the lower right roll 83 may be necessary to satisfy conditions of operation.

In operation of the illustrated embodiments, the foamed treating liquor can be supplied can controlled by apparatus such as disclosed in the aforementioned U.S. Pat. No. 4,237,818. When the devices of the embodiments begin operation, the slidable bars 54 and plugs 55 are caused to move outwardly beyond the edges of the substrate S so that liquor remaining in the distribution chamber following the last operation can be purged through the outer edges of the passageway beyond the edges of the substrate S before the substrate S is caused to travel. When purging has been completed, the slidable bars 54 and plugs 55 are reset for control by the electric eye sensors 75 and the substrate S is started in its travel, during which the foamed treating liquor is introduced into the distribution chamber 56, distributed transversely therein and circumferentially to the applicator nozzle 30 and onto the substrate S through the opening in the passageway 42 in the nozzle 30. With the arrangement 79 of FIG. 15, the foamed treating liquor is introduced adjacent the nozzle and travels first downwardly away from the nozzle and around under the cylindrical supporting surface through the vertical plane of the axis and upwardly to the nozzle, which is the reverse of the direction of flow of the top applicator devices illustrated in FIGS. 1–14, which reversal results from the inversion of the device to provide a bottom applicator.

If desired a holddown device can be incorporated in opposition to the applicator nozzle to hold the traveling textile substrate in position against the nozzle for effective application of the foamed treating liquor onto the substrate. An example of such a holddown device is disclosed in the aforesaid U.S. Pat. No. 4,237,818, which could be modified to act on the underside of a traveling substrate.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. Means for applying foamed treating liquor to a flat width of traveling substrate comprising a cylindrical supporting member mounted to extend transversely across the width of the traveling substrate adjacent a surface of the substrate, an applicator nozzle mounted on said cylindrical supporting member and projecting therefrom into foam applying disposition across the width of the substrate, a cover plate mounted on said cylindrical supporting member in spaced relation to the surface thereof to form a foam distribution chamber therebetween and communicating with said nozzle for distributing foamed treating liquor thereto, side walls mounted on said surface of said cylindrical supporting member and supporting said cover plate to define the transverse extent of said distribution chamber, and an inlet port communicating with said distribution chamber at a circumferential spacing from said nozzle and intermediate the transverse extent of said cylindrical supporting member, said side walls diverging from a relatively close spacing at said inlet port to approximately the full width of said nozzle at said nozzle, whereby foamed treating liquor introduced into said chamber through said inlet port will be distributed transversely through the width of said chamber as it flows circumferentially to said nozzle for application from said nozzle across the width of said substrate.

2. Means for applying foamed treating liquor according to claim 1 and characterized further in that said cover plate extends circumferentially over a major circumferential extent of the surface of said cylindrical supporting member.

3. Means for applying foamed treating liquor according to claim 1 and characterized further in that said inlet port is adjacent said nozzle and said cover plate extends circumferentially from adjacent said nozzle around a major circumferential extent of the surface of said cylindrical supporting member to said nozzle.

4. Means for applying foamed treating liquor according to claim 1 and characterized further in that said applicator nozzle projects substantially vertically from said cylindrical supporting member in substantially the same vertical plane as the axis of said cylindrical supporting member, said inlet port is disposed on one side of said vertical plane, and said cover plate extends circumferentially from said inlet port over a major circumferential extent of the surface of said cylindrical supporting member through said vertical plane and around to said applicator nozzle.

5. Means for applying foamed treating liquor according to claim 4 and characterized further in that said applicator nozzle projects vertically downward from said cylindrical supporting member and said cover plate extends upwardly from said inlet port over the top of said cylindrical supporting member and downwardly to said applicator nozzle on the side of said vertical plane opposite said inlet port.

6. Means for applying foamed treating liquor according to claim 4 and characterized further in that said applicator nozzle projects vertically upward from said cylindrical supporting member and said cover plate extends downwardly from said inlet port under the bottom of said cylindrical supporting member and upwardly to said applicator nozzle on the side of said vertical plane opposite said inlet port.

7. Means for applying foamed treating liquor according to claim 1 and characterized further by a conduit connected to said inlet port for introducing foamed treating liquor into said distribution chamber, said conduit having a portion at said inlet port disposed at an acute angle to the adjacent circumferential extent of said cover plate to cause a substantial change in direction of flow of the foamed treating liquor as it enters said distribution chamber, thereby facilitating transverse distribution of said foamed treating liquor in said distribution chamber.

8. Means for applying foamed treating liquor according to claim 1, 2, 3, 4, 5, 6, or 7 and characterized further in that said side walls are in the form of resilient sealing strips.

9. Means for applying foamed treating liquor according to claim 8 and characterized further by means for tightening said cover plate in a circumferential direction to bias said cover plate in sealing disposition against said side walls.

10. Means for applying foamed treating liquor according to claim 9 and characterized further in that one end of said cover plate is secured to said applicator nozzle and said tightening means engages the other end of said cover plate.

11. Means for applying foamed treating liquor according to claim 10 and characterized further in that said cover plate is releasably secured to said applicator nozzle and said tightening means is releasable to permit easy removal of said cover plate from said cylindrical supporting member for ready access to the interior of said distribution chamber.

12. Means for applying foamed treating liquor according to claim 1, 2, 3, 4, 5, or 6 and characterized further in that said cylindrical supporting member is hollow, end closures are slidable in the ends of said applicator nozzle to limit the transverse foam applying extent thereof, and means for manipulating said end closures to adjust the transverse positions thereof is mounted within said hollow cylindrical supporting member.

13. Means for applying foamed treating liquor according to claim 12 and characterized further in that said manipulating means is a piston cylinder mechanism mounted within each end of said cylindrical supporting member and projecting transversely outward therefrom for connection to transversely extending portions of said slidable end closures.

14. Means for applying foamed treating liquor according to claim 1, 2, 3, 4, 5 or 6 and characterized further by means projecting from said surface of said cylindrical supporting member transversely across said distribution chamber adjacent said applicator nozzle and of a projecting extent less than the depth of said distribution chamber for restricting flow of foamed treating liquor therepast and thereby facilitate transverse distribution of said foamed treating liquor in said distribution chamber.

15. Means for applying foamed treating liquor according to claim 14 and characterized further in that said restricting means is in the form of a plate-like projection having an appreciable circumferential extent within said distribution chamber, thereby facilitating uniform transverse distribution of foamed treating liquor across said distribution chamber with widely diverging side walls and a correspondingly circumferentially small cylindrical supporting member.

16. Means for applying foamed treating liquor according to claim 15 and characterized further in that the circumferential extent of said plate-like projection varies across said distribution chamber to effect uniform distribution of foamed treating liquor within said distribution chamber to said applicator nozzle.

17. Means for applying foamed treating liquor according to claim 16 and characterized further in that said plate-like projection tapers from a maximum circumferential extent at substantially the transverse center to minimum circumferential extents at the transverse sides of said distribution chamber.

* * * * *

UNITED STATES PATENT OFFICE

CERTIFICATE OF CORRECTION

Patent No. 4,402,200 Dated September 6, 1983

Inventor(s) Graham Frank Clifford and James Keith Turner

It is certified that error appears in the above-identified patent and that said Letters Patent are hereby corrected as shown below:

Column 1, line 27, delete "and" and insert therefor --an--.

In the Abstract, first sentence, after "foamed" insert --treating liquor to a flat--.

Signed and Sealed this

*Twenty-second* Day of *October 1985*

[SEAL]

*Attest:*

DONALD J. QUIGG

*Attesting Officer*

*Commissioner of Patents and Trademarks—Designate*